US006433318B2

(12) United States Patent
Danko

(10) Patent No.: US 6,433,318 B2
(45) Date of Patent: Aug. 13, 2002

(54) ELECTRIC HEATER ASSEMBLY WITH IN-LINE THERMOSTAT

(76) Inventor: Michael Danko, 750 Timber La., Cookeville, TN (US) 38501

( * ) Notice: Subject to any disclaimer, the term of this patent is extended or adjusted under 35 U.S.C. 154(b) by 0 days.

(21) Appl. No.: 09/852,947

(22) Filed: May 11, 2001

Related U.S. Application Data

(60) Provisional application No. 60/255,042, filed on Aug. 11, 2000.

(51) Int. Cl.[7] ..... H05B 3/06

(52) U.S. Cl. ..... 219/536; 219/532; 219/541; 219/402; 392/487; 373/114; 373/119; 432/209

(58) Field of Search ..... 219/402, 404, 219/536, 541, 459.1, 408, 537, 520, 532, 400; 392/487; 373/114, 119, 1, 128, 129–131; 432/209; 338/316–320

(56) References Cited

U.S. PATENT DOCUMENTS 3,631,525 A * 12/1971 Brasch ..... 219/366
3,641,312 A * 2/1972 Ammerman et al. ..... 219/532
3,770,939 A 11/1973 Kokjohn
3,811,031 A * 5/1974 Mc Bride et al. ..... 219/374
3,890,487 A * 6/1975 Wightman et al. ..... 219/532
4,289,955 A * 9/1981 Seeley ..... 219/532
4,472,624 A * 9/1984 Janning ..... 219/532
5,641,420 A * 6/1997 Peterson et al. ..... 219/536
6,097,003 A * 8/2000 Markum et al. ..... 219/402

* cited by examiner

*Primary Examiner*—Teresa Walberg
*Assistant Examiner*—Shawntina T. Fuqua
(74) *Attorney, Agent, or Firm*—Patton Boggs LLP

(57) ABSTRACT

A heater having a frame supporting a heater element resistance wire and an in-line thermostat. The in-line thermostat has substantially flat connection terminals or terminals, each having a though hole. A substantially flat blade connects to each thermostat terminal by a single screw. The end of each blade distal from the screw is crimped to an end of the resistive wire or another conducting element. An insulating support mounts each blade to the frame. The blade may have bendable tabs for securing it to the insulating support.

7 Claims, 3 Drawing Sheets

ELECTRIC HEATER ASSEMBLY WITH IN-LINE THERMOSTAT

This application claim benefit of Provisional No. 60/225,042 filed Aug. 11, 2000.

BACKGROUND OF THE INVENTION

1. Field of the Invention

The present invention is directed toward an electric heating apparatus and, more particularly, to an apparatus having a resistance wire with an in-line thermostatic electric current control element.

2. Related Art

Electric heater assemblies having a resistance wire with in-line thermostats are known in the art. A widely used example of such heater assemblies employs a thermostat with a pair of terminals, each having a right-angled bend, with the right-angled portion of each being secured by a pair of threaded nuts to the threaded distal end of a mounting screw. Typically, there is a lock washer on all contacting faces of the threaded nuts.

One example of this prior art arrangement is disclosed in U.S. Pat. No. 3,770,939 (the '939 patent"), and is shown in prior art FIGS. 1A, 1B and 1C of this disclosure. Referring to the prior art FIG. 1A, and the enlargement of its region 1B shown by FIG. 1B, the prior art thermostat 10 has terminal flanges 14 and 16 extending therefrom, each having proximal and distal portions, labeled as 14A and 14B, and 16A and 16B, respectively. Distal portions 14B and 16B extend at right angles from their respective proximal portions 14A and 16A. Viewed from the FIG. 1B side projection AA, which is shown in FIG. 1C, the distal portion 16B has a U-shaped cut-out portion 16U, as does 14B (not shown).

As shown in prior art FIG. 1A, a ladder frame 17 supports a resistive wire heating element 18 using a plurality of first tubular insulating bushings 20. The bushings 20 are typically formed of ceramic. The frame 17 also supports a pair of second tubular insulating bushings 22 and 24.

Referring to prior art FIG. 1B, a first thermostat wire connection screw 26, having a head 26A and a threaded distal end 26B, extends through the first ceramic thermostat support bushing 22. Likewise, a second thermostat wire connection screw 28 extends through the second ceramic thermostat support bushing 24. A heater resistance wire end portion 30 is welded to the head 26A of the first screw 26. A first threaded nut 32, with an associated lock washer 34 secures the first screw 26 to its ceramic bushing 22. The second thermostat mounting screw 28 is secured to its corresponding bushing 24 by a second threaded nut 36 and associated lock washer 38.

As shown in the prior art FIG. 1B, a fuse element 40 connects to the head 28A of the second thermostat mounting screw by welding or by wrapping the connecting end 40A of the fuse under the screw head 28A, before tightening the second threaded nut 36. If the connecting end is wrapped under the screw head, as in FIG. 1B, a flat washer 41 is preferable.

The thermostat 10 within prior art FIGS. 1A–1B is mounted as follows:

The first and second thermostat mounting screws 26 and 28 are secured to their respective bushings 22 and 24 by tightening the first and second threaded nuts 32 and 36. After this assembly, a spacing A is between the inner faces of the first and second threaded nuts. Referring to FIG. 1B, the distance labeled A' is from the distal portion 14B of the first flange 14 of the thermostat 10 to the distal portion 16B of the second flange 16. The dimension A' is slightly less than A. Referring to FIG. 1C, which depicts the U-shaped cutout 16U of the second flange 16, the cut-out is shaped and dimensioned to accommodate the threaded portion 28B of the second screw 28. Likewise, the cut-out (not shown) in the first flange 14 accommodates the threaded portion 26B of the first screw 26. Because of the dimensions A and A', and the U-shaped cutouts in the thermostat flange distal portions 14B and 16B, the thermostat 10 can be placed into the position shown in FIGS. 1A and 1B. After such positioning the distal portion 14B of the first flange 14 of thermostat 10 is secured by a third nut 42, typically with a pair of lock washers (not shown), one on each side of the distal portion 14B flange. In a mirror arrangement, the distal portion 16B of the second flange 16 is secured by a fourth nut 44, also typically with a pair of lock washers (not shown).

Although the above-described prior art structure mounts the thermostat 10 to the frame 17 in line with the heating element, there are shortcomings. One is the number of parts, namely six lock washers, one flat washer, four threaded nuts, and two screws. This quantity of parts creates and carries numerous costs, including vendor selection and monitoring costs, inventory costs, and quality control costs.

Another shortcoming is that the manual labor required to assemble its plurality of parts is time intensive. More specifically, the nuts 32, 36, 42 and 44 must be hand tightened by applying repeated short swing rotations with a small open-ended wrench.

Another shortcoming is that the heater resistance wire end portion 30 is welded to the head 26A of the first screw 26, and typically the welding is performed before the thermostat 10 is installed. Still further, the end of the fuse element 40 must be bent in two in two planes using an off-line subassembly operation such as, for example, hand-bending with a pair of needle-nose pliers, to properly wrap the end around the screw head 28A. This bending operation adds manufacturing cost.

Referring to prior art FIGS. 1A–1B, still another shortcoming with such structure is that external connection terminals 46 are typically supported by third bushings 48. The third bushings 48 are different from the second bushings 22 and 24 which support the first and second thermostat screws 26 and 28. The result is a further increase in the parts count.

SUMMARY OF THE INVENTION

An object of the present invention is a heater apparatus having a frame supporting a resistance wire with an in-line thermostat having a reduced parts count as compared to the prior art.

Another object is a heater apparatus having a frame supporting a resistance wire with an in-line thermostat that is easier and quicker to assemble than the thermostat mounting apparatus of the prior art.

Still another object is a heater apparatus having a frame supporting a resistance wire with an in-line thermostat and an in-line fuse, with a mounting structure for the fuse having a reduced part count as compared to the prior art.

Another object is a heater apparatus having a frame supporting a resistance wire with an in-line thermostat and with external connection tabs mounted to the frame, where the thermostat and connection tab mounts employ identical components.

Yet another object of the present invention is a heater apparatus having a frame supporting a resistance wire with an in-line thermostat, employing a standard thermostat with flat terminals which have a threaded hole added for accepting a screw.

Still another object of the present invention is a heater apparatus having a frame supporting a resistance wire with an in-line thermostat, with a thermostat mounting structure that does not require welding attachments to the thermostat terminals.

A further objective of the present invention is a heater apparatus having a frame supporting a resistance wire with an in-line thermostat, employing uniform flat profile terminals for crimping to resistance wire ends and fuse wire ends, and for functioning as external electrical connection tabs and for single-screw attachment to the thermostat terminals.

Related to the above-identified objective, a still further objective is a structure for accommodating and mounting an in-line thermostat in a selectable rotational orientation. The selectable orientation provides improved access for servicing and replacing the thermostat in an installed heater assembly.

An example embodiment of the invention includes a metal frame supporting a plurality of first insulators supporting a heater element resistance wire. The frame further supports a pair of thermostat support insulators, or bushings which, in turn, support a pair of thermostat mounting blades. A thermostat having two extended terminals is secured to the pair of thermostat mounting blades, by one threaded screw attaching one thermostat terminal to a first of the thermostat mounting blades and by one threaded screw attaching the other thermostat terminal to the other thermostat mounting blade. Each of the thermostat mounting blades has a longitudinal axis, with an outer crimping portion at one end and a screw tab at the other. The screw tab includes a through hole for engaging or accommodating the threaded screw attaching the thermostat mounting blade to the thermostat terminal. Each of the thermostat mounting blades further includes an axial abutment to limit insertion into the thermostat mounting insulator.

The first thermostat mounting blade is crimped onto an end of the resistive wire and inserted into the first bushing until the axial abutment is against the outer face of the bushing and the screw tab, with its through hole, protrudes from the inner face of the bushing. Likewise the second thermostat mounting blade is crimped onto an end of a fuse or other conductive element and inserted into the second bushing until the axial abutment is against the outer face and the screw tab protrudes from the inner face. The thermostat is then connected, using one screw for each terminal flange, to the protruding screw tabs of the terminal mounting blades. The assembly of the thermostat and the pair of terminal mounting blades is thus secured, in an axial direction, within the pair of bushings by the axial abutment of the first terminal mounting blade being against the outer face of the first bushing and the axial abutment of the second terminal mounting blade being against the outer face of the second bushing.

A further embodiment of the invention includes a bendable securing abutment disposed on the tab portion of the thermostat mounting blades. The bendable securing abutment is disposed to be exposed past the inner face of the bushing after the thermostat mounting blades is inserted through the center hole such that the axial abutment is against the outer face of the bushing. The bendable securing abutment is then bent or otherwise deformed to have a height greater than the height of the through hole of the bushing. Each thermostat mounting blade is thus secured against axial movement by the contact of its axial abutment against the outer face of the bushing it is inserted through, and by the bendable securing abutment being against the inner face of that bushing.

A still further embodiment includes a thermostat mounting bushing having a through hole that accommodates the thermostat mounting blade in more than one rotational orientation about the blade's longitudinal axis. This provides for mounting the in-line thermostat in a selectable rotational orientation. The selectable orientation provides improved access for servicing and replacing the thermostat in an installed heater assembly. An example of this embodiment is a thermostat mounting bushing having a first and a second through hole. The first through hole accommodates the thermostat mounting blade, or other hardware, in a first or second orientation, the second being 180 degrees relative to the first. The second through hole has a cross-sectional profile the same as the first, and has the same longitudinal axis as the first but is rotated by, for example 90 degrees. The second through hole accommodates the thermostat mounting blade in a third and fourth orientation, the fourth being 180 degrees relative to the third. The first and second through holes thereby permit four orientations of the thermostat mounting blades and, thus, four rotational orientations for mounting the thermostat or other hardware.

The apparatus of this invention provides significant reduction in the number of parts required to connect the thermostat to the electric heater assembly.

The invention also, by using simple crimping of the thermostat mounting blades onto the resistive wire or other elements, and then insertion into their support bushings followed by single-screw attachment to the thermostat terminals, reduces the amount of time and difficulty associated with manual assembly of the in-line thermostat to the electric heater assembly.

BRIEF DESCRIPTION OF THE DRAWINGS

These and other aspects of the invention will become apparent from a reading and understanding of the following detailed description of a preferred embodiment of the invention, together with the following drawings of which.

DETAILED DESCRIPTION OF THE INVENTION

Figure 2B:
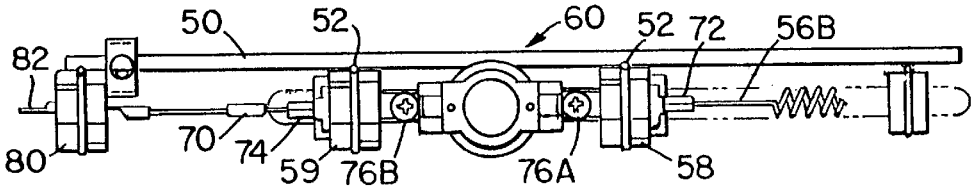
FIG. 2B shows a side projection of the example embodiment shown in FIG. 2A, viewed from the projection BB.
Figure 2A:
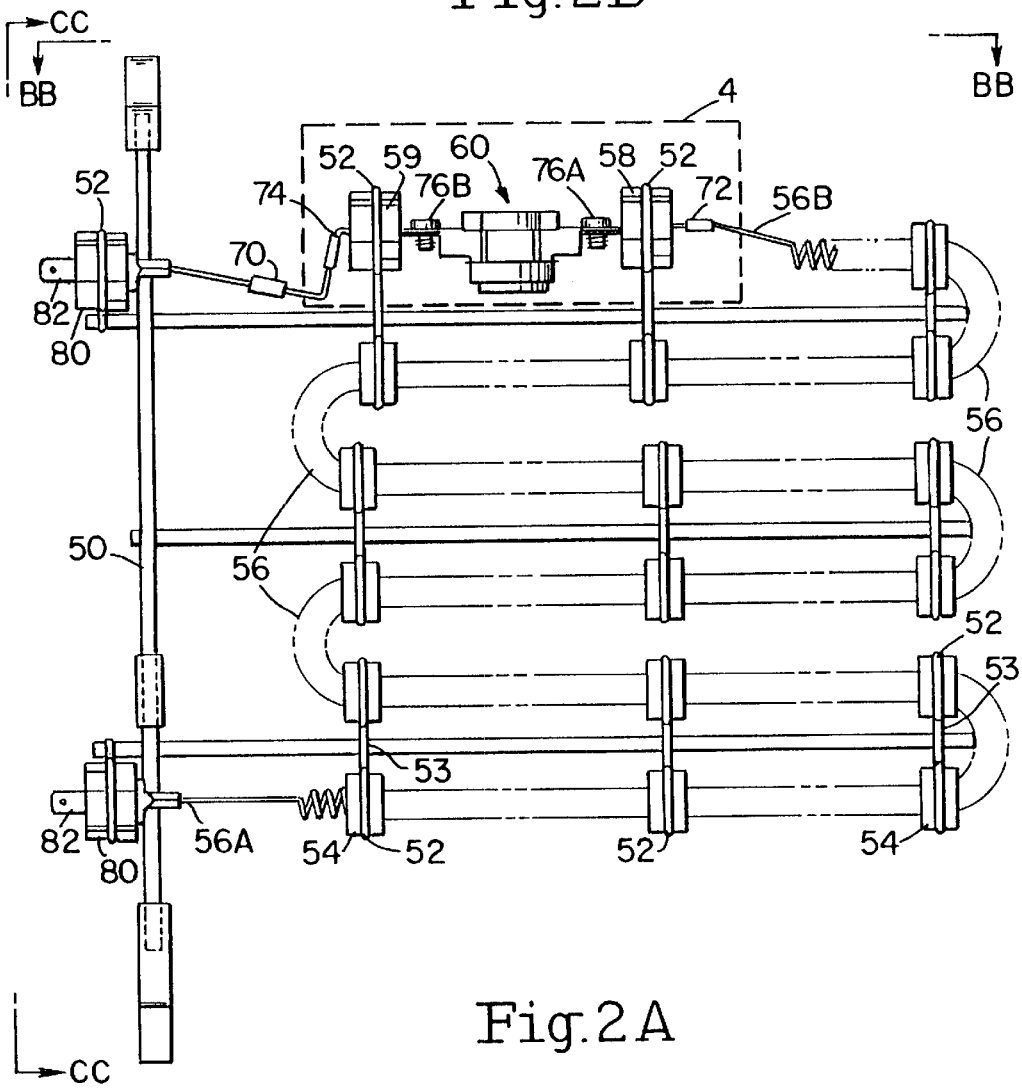
FIG. 2A shows, in a top projection view, an example embodiment of the in-line thermostat apparatus according to the invention, with an example frame and resistive wire.
Figure 2C:
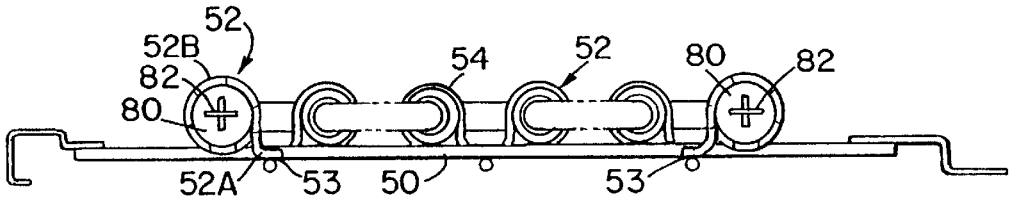
FIG. 2C shows a front projection of the example embodiment shown in FIG. 2A, viewed from the projection CC.

Referring to FIGS. 2A–2C, an example embodiment of the invention comprises a ladder-type frame 50, with a plurality of resistive wire support bushing mounts 52 welded to the frame at a corresponding plurality of points 53. Each of the resistive wire support bushing mounts 52 supports a ceramic resistive wire support bushing 54. The example ceramic resistive wire support bushing 54 has a center through passage (not labeled) with a diameter (not labeled) dimensioned to support, but not grip, a coil-shaped resistive wire such as item 56. This allows motion of the resistive wire coil due to heat expansion. As shown in FIG. 2A, the resistive heating wire 56 extends from a first connection terminal 56A, through the center of each of the plurality of ceramic resistive wire support bushings 54, to a second terminal end 56B.

The shape and form of the ceramic resistive wire support bushings 54, and their respective mounts 52, are for purposes of example only. Referring to the CC projection of FIG. 2A, which is shown in FIG. 2C, each resistive wire support bushing mount 52 is a metal wire rod with a center portion 52A welded to the frame 50, with two semi-circle ears 52B. Each of the semi-circle ears 52B wraps around and securely grips a ceramic resistive wire support bushing 54. Alternatively, the frame 50 may be configured (not shown) to support bushings (not shown) similar to items 54 in the manner that the bushings 20 are supported in the prior art FIG. 1A. Many other shapes and arrangements for supporting a resistive wire element are known and contemplated for use with the present invention.

Referring to FIG. 2A, two of the semi-circle ears 52B support a respective pair of ceramic thermostat support bushings, labeled 58 and 59, instead of ceramic resistive heater wire bushings 56. For this description the bushings 58 and 59 have identical form. Referring to FIG. 4, which is detailed view of the region in FIG. 2A labeled as 4, a thermostat 60 having a first connection terminal 61A and a second connection terminal tang 61B is supported by the bushings 58 and 59 as shown in FIGS. 3 and 4.

Figure 3:
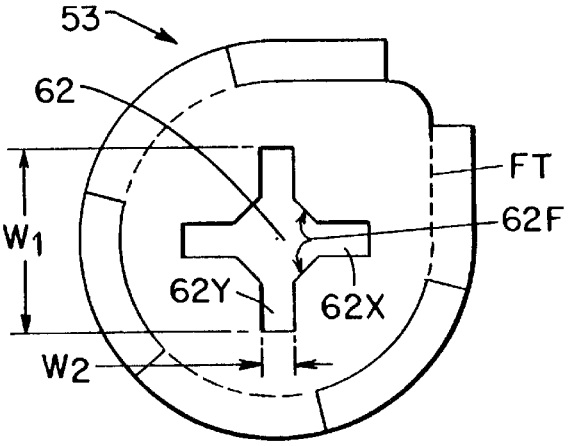
FIG. 3 is a detailed view of the thermostat support bushing from the example embodiment of FIGS. 2A–2C, seen from direction of the projection view CC.
Figure 4:
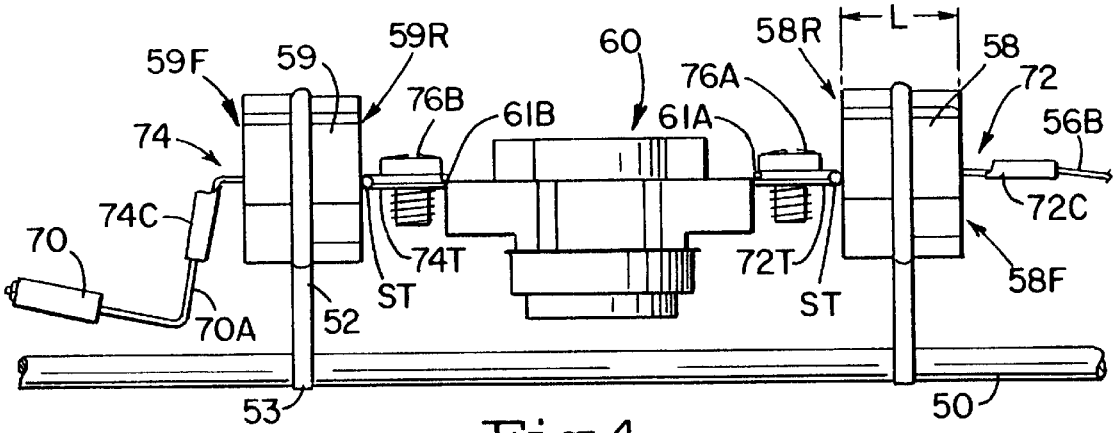
FIG. 4 is an enlargement of the in-line thermostat and mounting structure surrounded by the broken line labeled 4 in FIG. 2A.

FIG. 3 shows an example ceramic thermostat support bushing 58, also representing the bushing 59, viewed from the projection CC of FIG. 2A. As seen from FIG. 3, the example bushing 58 preferably has a generally cylindrical outer form, with a flat FT conforming to a flat region (not labeled) of the ear-shaped portion 52B of the wire support 52 shown in FIGS. 2A and 2C, and a star or cross-shaped through hole 62. The flat FT and corresponding flat region of the support ear 52B, although not essential, prevent the bushing 58 (and 59) from rotating.

Referring to the example of FIG. 3, the through hole 62 is formed of a first rectangular through hole 62X and a second rectangular through hole 62Y substantially collinear with 62X, but rotated approximately 90 degrees around its longitudinal axis, relative to 62X. The inner perimeter of the through hole 60 is a square defined by the four flats 62F. Referring to FIG. 4, the through hole 62 of FIG. 3 extends a length L, which is the distance from the front face 58F to the back face 58R. Each of the through holes 62X and 62Y has a width W1 and a height W2.

Figure 5:
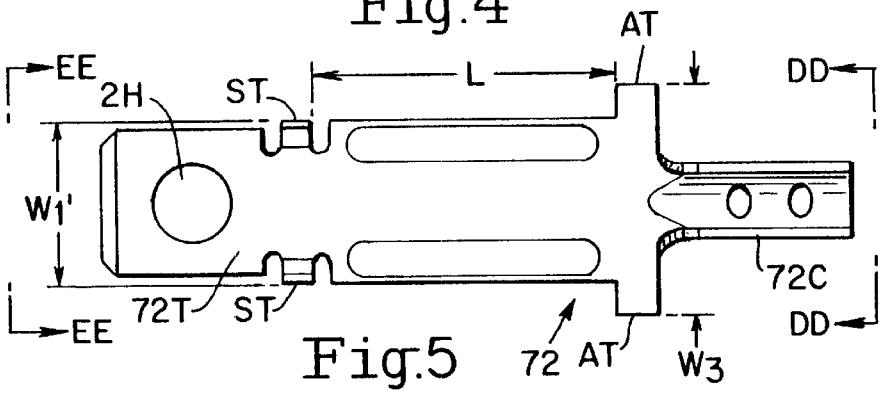
FIG. 5 is a top projection view of a thermostat mounting blade from the example embodiment shown in FIG. 2A.

Referring to FIGS. 3 and 4, a first mounting thermostat blade 72 extends through the hole 62X or 62Y (not seen in FIG. 4) of the first ceramic bushing 58, and a second thermostat mounting blade 74 extends through the hole 62X or 62Y (not seen in FIG. 4) of the second ceramic bushing 59. FIG. 5 shows a top projection of an example first thermostat mounting blade 72 and, for purposes of this description, an example 74 which is identical. The width W1' is slightly less than the width dimension W1 of the through hole 60X (and of 60Y) in the ceramic bushings 58 and 59, as shown in FIG. 3. The thickness W2' of the thermostat blade 72 (and 74) is slightly less than the height dimension W2 of the through holes 62X and 62Y. On the other hand, the dimension W3 spanned by the abutment tabs AT is greater than the width dimension W1 of the through holes 62X and 62Y. These dimensions allow the thermostat blades 72 (and 74) to be inserted into the hole 62X or 62Y, until the abutment AT contacts the outer face 58F (or 59F), whereupon the tab 72T (or 74T) protrudes past the inner face 58R of bushing 58 (or the inner face 59R of bushing 59). The example of the thermostat mounting blade 72 depicted in FIG. 5 shows bendable securing tabs ST. The bendable securing tabs ST are an optional structure which is described further below, and may be omitted.

Figure 6:
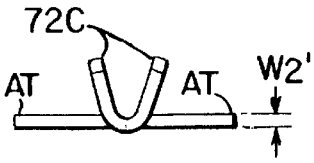
FIG. 6 is a projection view of the thermostat mounting blade shown in FIG. 5, seen from the FIG. 5 projection view DD, after the crimping portion is deformed into a crimping position.

Referring to FIGS. 4 and 5, a crimp portion 72C of the first thermostat mounting blade 72 extends outward from the bushing outer face 58F and is crimped around the terminal end 56B of the resistive heating wire 56. FIG. 6 shows the crimp portion 72C, viewed from the projection view DD of FIG. 5, after being deformed to crimp, for example, the terminal end 56B. A tab 72T of the first thermostat mounting blade 72 protrudes from the bushing inner face 58R and contacts the first thermostat terminal 61A. Referring to FIG. 4, a threaded screw 76A passes, in this example, through a clearance hole, shown as 72H in FIG. 5, in the tab 72T and threads into a threaded through hole (not shown) formed in the first thermostat terminal 61A.

Similar to the first thermostat mounting blade 72, a crimp portion 74C of the second mounting thermostat blade 74 extends outward from the outer face 59F of the second bushing 59 and is crimped to the terminal end 70A of a fuse 70 or another wire element (not shown). A tab 74T protrudes from the inner face 59B of the bushing 59 and contacts the second thermostat terminal 61B. A threaded screw 76B passes, in this example, through a clearance hole, such as the hole 72H shown in FIG. 5, in the tab 74T and threads into a threaded through hole (not shown) formed in the second thermostat terminal 61B.

Referring to FIGS. 4 and 5, the thermostat 60 and the first and second thermostat mounting blades 72 and 74 are secured from axial movement by the abutment AT (not shown in FIG. 4) of the first thermostat mounting blade 72 being against the outer face 58F of the first bushing 58, and by the abutment (corresponding to AT of FIG. 5, but not shown in FIG. 4) of the second thermostat mounting blade 74 being against the outer face 59F of the second bushing 59.

The above-described securing arrangement between each of the thermostat terminals 61A and 61B and its respective terminal blade tab 72T and 74T, respectively, is for purposes of example only. Alternative securing means are readily seen by one of ordinary skill upon reading this disclosure. For example, instead of the thermostat terminals 61A and 61B having a threaded through hole and the tabs 72T and 74T of the thermostat mounting blades having a clearance hole, the arrangement could be reversed, with the threaded through hole formed in the thermostat mounting blades. A drawback to such an arrangement is that the thermostat mounting blade would, preferably, have to be multiple screw thread lands in thickness. Another alternative is to form a clearance hole in each of the thermostat terminal 61A and 61B, and in each of the tabs 72T and 74T, and to secure each terminal and tab with a screw and a nut (not shown) threaded onto the distal end of the screw. This arrangement, however, requires additional parts and assembly time as compared to the example depicted in FIG. 4.

Another alternative is that instead of the abutment tabs such as AT of FIG. 5, a dimple (not shown) could be preformed on the thermostat mounting blade 72 (and 74) on the same location along the longitudinal axis as AT, having a height greater than W2, which would prevent further insertion of the blade 72 (or 74) into the bushing 58 (or 59).

Figure 7:
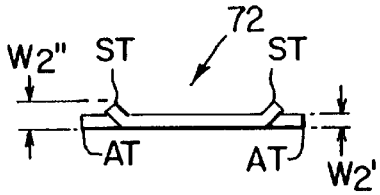
FIG. 7 is a projection view of the thermostat mounting blade shown in FIG. 5, seen from the FIG. 5 projection view EE, after its holding tabs are bent to a securing position.

Referring to FIGS. 5 and 7, an example mechanism for further securing the example thermostat mounting blades from axial movement within the assembly of FIG. 4 will be described. More particularly, FIG. 5 shows an example thermostat mounting blade 72 having a bendable securing tab ST. The dimension L' from the securing tab ST to the abutment tabs AT is only slightly greater than the length L of the bushings 58 and 59. As described above, the bendable securing tab ST is not a necessary structure, as the abutments AT secure the thermostat mounting blades 72 and 74 after the thermostat 60 is attached to the tabs 72T and 74T. For this embodiment, however, the bendable securing tab ST is included.

Referring to FIGS. 4, 5 and 7, the securing tabs ST of the thermostat mounting blade 72 (or 74), before the blade 72 (or 74) is inserted through the bushing 58 (or 59) has a height dimension equal to W2'. As described above, W2' is less than the height W2 of the through hole 62X and 62Y, thereby allowing the thermostat mounting blade 72 (or 74) to be inserted through the bushing 58 (or 59) until the abutment tab AT contacts the outer face 58F (or 59R) of the bushing. Because the dimension L' is only slightly greater than the length L of the bushings 58 and 59, the securing tabs ST are just beyond the inner face 58R of the bushing 58 (and the inner face 59R of the bushing 59) after this insertion. Then, the securing tabs ST are bent, or otherwise deformed using, for example, a pair of needle-nosed pliers, to have the form shown in FIG. 7, which is the view form the projection view EE of FIG. 5. After this bending, the height W2" is greater then the height W2 of the through holes 62X and 62Y. As a result, the first thermostat mounting blade is secured within the bushing 58 by the abutment AT being against the outer face 58F and the securing tab St being against the inner face 58R.

Referring to FIG. 3, it is to be understood that the bushings 58 may be formed with only one through hole 62X, instead of 62X and 62Y. Using a single through hole 62X may, however, reduce the design flexibility. A reason is that using the two holes 62X and 62Y allows four, instead of two, rotational orientations of the FIG. 5 thermostat mounting blade 72 (and 74) and, thus, of the thermostat 60.

Referring to FIG. 3, it is also to be understood that the square inner perimeter defined by the four surfaces 62F extending through the bushing 58 (and 59) permit a square cross-section as an alternative (not shown) to the FIG. 5 first thermostat mounting blade 72 (and the second blade 74). It is also to be understood that a round cross-section alternative (not shown) to the FIG. 5 first thermostat mounting blade 72 (and the second blade 74) may be used, with the diameter (not shown) being smaller than the dimension between facing surfaces 62F. The round cross-section alternative would preferably have flat portion (not shown) corresponding to the tab 72T of the FIG. 5 example first thermostat mounting blade 72, and through hole (not shown) corresponding to the hole 72H.

The above-described structure of the in-line thermostat 60, the thermostat mounting blades 72 and 74, ceramic thermostat support bushings 58 and 59, and the thermostat screws 76A and 76B, enable a rapid assembly of the in-line thermostat 60 and resistive wire element 56 as follows:

The crimping portion 72C of thermostat mounting blade 72 is crimped using, for example, a conventional off-line crimping machine, onto the end 56B of the resistive wire 56. Next, the crimping portion 74C of thermostat mounting blade 74 is crimped onto the end 70A of the fuse element 70, or other conducting element (not shown). The thermostat blade 72 is then inserted, into a selected one of the through holes 6OX and 60Y of the first ceramic thermostat support bushing until its abutment tabs AT contact the front face 58F of the first bushing 58. The selection between 60X and 60Y is based on the desired orientation of the thermostat 60. Next, the thermostat blade 74 is inserted, through the similarly selected one of the two through holes 60X and 60Y in the second ceramic thermostat support bushing 59, until its abutment tabs AT contact the front face 59F of than bushing. The thermostat 60 is then secured by threaded screws 76A and 76B as shown in FIGS. 2A and 4.

The described installation sequence is for purposes of illustrating the apparatus of this invention requiring only two screws (such as items 76A and 76B), and not requiring welding. One example alteration in the assembly is that the thermostat terminal 61A could be secured to the first thermostat mounting blade 72 before installing the second thermostat mounting blade 74.

The above-described assembly operation references the FIG. 3 example bushings 58 and 59 which have the through holes 62X and 62Y, using a rectangular cross-section thermostat mounting blade 72 as shown in FIG. 5. The assembly would be substantially the same if a single through hole bushing (not shown), having only 62X or 62Y, were used, except that the thermostat mounting blades 72 and 74 could be inserted in only one orientation relative to the bushing.

If the optional bendable securing tabs ST shown in FIG. 5 are included, and if used as described above, then the only difference in the assembly process is the added step of bending the tabs in to the position shown in FIG. 7, using needle-nosed pliers or other tools, prior to assembling the thermostat 60 to the thermostat mounting blades 58 and 59 using the screws 76A and 76B.

Another alternative is that instead of the securing tabs ST, a partial perforation (not shown) could be formed in a location (not shown) of the thermostat mounting blade 72 (and 74) such that after inserting the blade until the abutment tab AT contacts the bushing face 58F (or 59F), a metal portion of the tab 72 (or 74) weakened by the perforation would be just beyond the back face 58R (or 59R). The weakened portion (not shown) could then be pushed out with a small diameter metal punch to a degree such that the pushed-out portion of the thermostat mounting blade would contact the back face 58R (or 59R) if pulled toward the face 58F (or 59F), thereby securing the tab from axial movement.

Referring to FIG. 2A, another feature of this invention is that one or more additional bushings such as items 58 and 59, an example being shown and labeled as 80, may be installed. The configuration of the bushing 58 and its cooperation with the axial abutment AT and bendable tab ST of the thermostat mounting blades 72 (and 74), as shown in FIG. 3, allows the same bushing to support connection elements other than the thermostat mounting blades 72 and 74, such as the external connection blade 82 shown in FIGS. 2A and 2C. The external connection blade 82 is substantially similar to the thermostat mounting blades 72 and 74, in that it employs abutment tabs (not shown) and bendable tabs (not shown) for ease of assembly and security against axial motion, substantially the same as the tabs AT and ST described above. An advantage of this feature is that a common bushing can be used for items 58, 59 and 80, which provides a reduced parts compared to the prior art, as shown in FIGS. 1A and 1B, using a bushing 48 to support the external terminal 46 which is different than the bushings 22 and 24 used to support the thermostat 10.

The described invention provides a mount for in-line thermostats having a reduced parts count as compared to the prior art. More particularly, referring to FIGS. 2A, 2B and 4, the thermostat 60 is mounted to the bushings 58 and 59 using two screws, namely items 76A and 76B, and two thermostat mounting blades, namely items 72 and 74. The total parts count is four. As described above, the prior art mounting shown in FIGS. 1A and 1B uses two screws, four nuts, approximately four lock washers, and a number of flat washers. In addition, the present invention uses flat thermostat terminals 61A and 61B, as compared to the terminals 14 and 16 of the prior art, which have 90 degree bends and u-shaped cutouts.

Figure 1A:
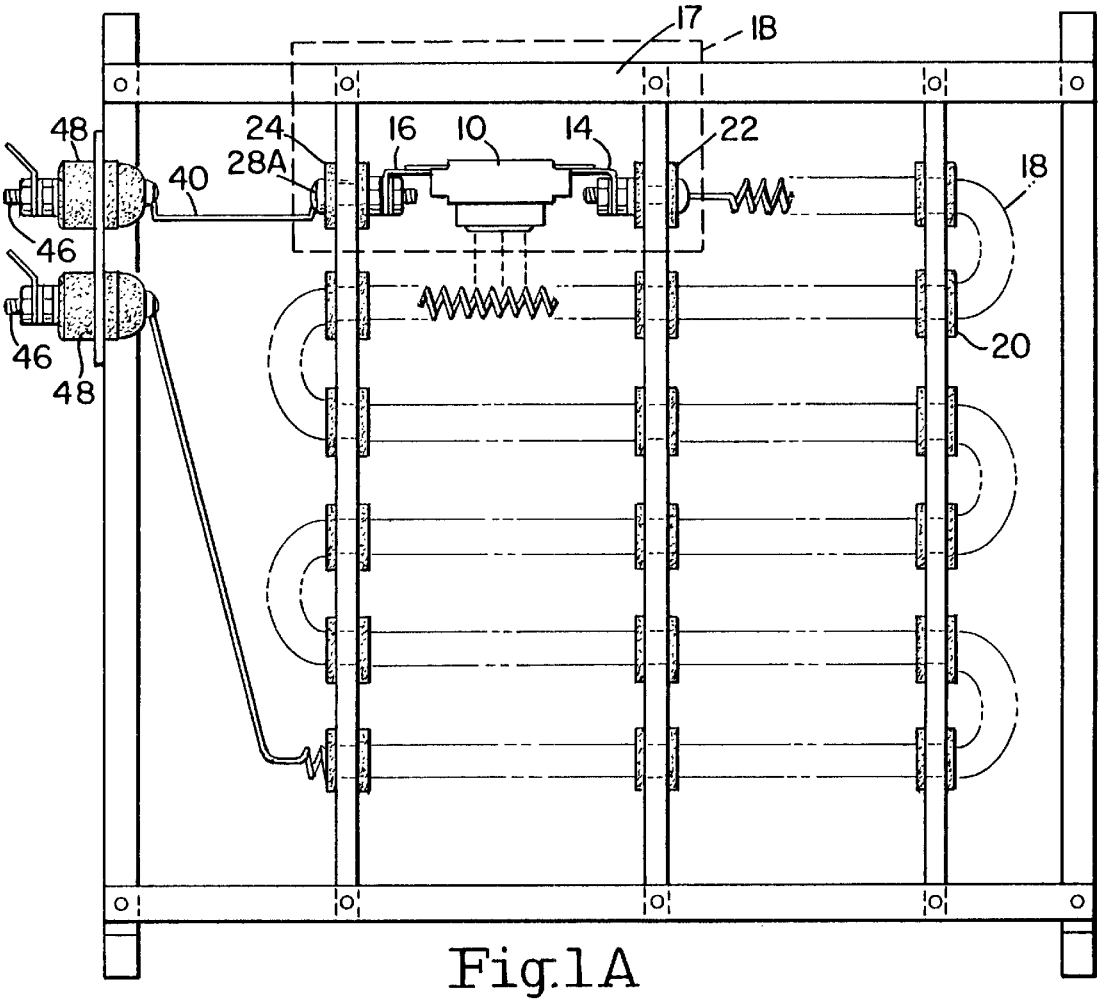
Fig.1A PRIOR ART
FIG. 1A shows an example prior art arrangement of a heater element frame supporting a heater element with an in-line thermostat.
Figure 1B:
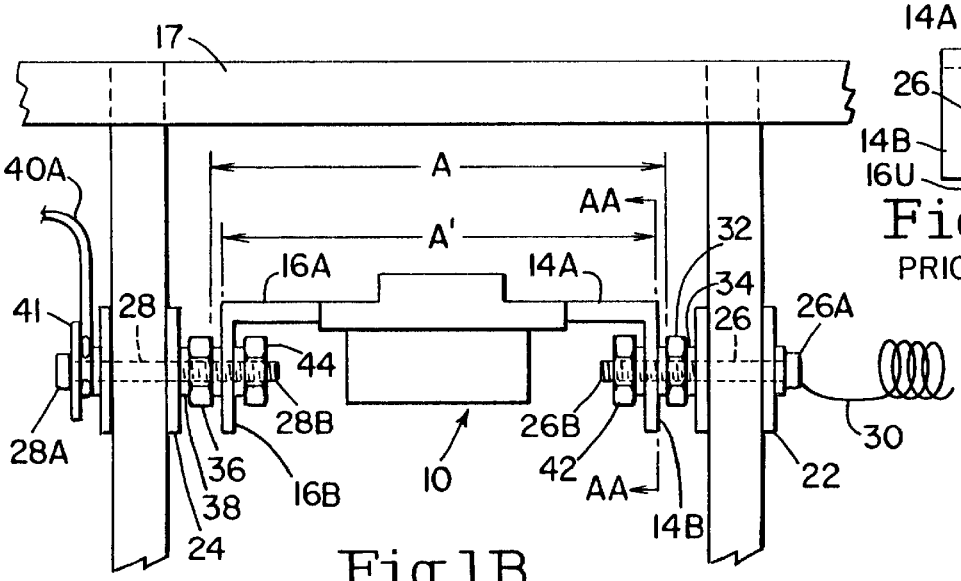
Fig.1B PRIOR ART
FIG. 1B shows an enlargement of the thermostat mounting structure depicted in FIG. 1A.
Figure 1C:
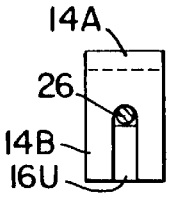
Fig.1C PRIOR ART
FIG. 1C shows a side projection of the thermostat flange of FIGS. 1A and 1B, viewed from the sectional view AA of FIG. 1B.

The described invention also provides a mount for the thermostat 60 which makes removal and replacement of the thermostat 60 significantly easier than removal and replacement of the thermostat 10 shown in FIGS. 1A–1B. The problem with the prior art is significant, as the present inventors have identified that accessing the mounting nuts 32, 36, 42, and 44 of the prior art mounting structure is such that complete equipment disassembly is frequently required to access and remove the thermostat 10. This problem is substantially eliminated by the present invention.

The problem is substantially eliminated because the screws 76A and 76B of the present invention are significantly more accessible and removable once the heater unit is installed than are the four nuts 32, 36, 42, and 44. More particularly, it is generally much easier for a service person to insert a long shaft screwdriver (not shown) through typical access plate (not shown) than it is to reach in, if possible, with a wrench and, with a succession of short swing arcs, attempt to remove the four nuts 32, 36, 42, and 44. The optional through holes 62X and 62Y shown in FIG. 3 make servicing, or replacement, of the installed thermostat 60 even easier, namely because the thermostat 60 may be originally installed in one of four rotational orientations. This allows an original orientation of the thermostat 60 such that the screws 76A and 76B are accessible through an access panel (not shown). Further, it can be seen that a square or round through hole (not shown) in the bushings 58 and 59, instead of the rectangular through holes 62X and 62Y, together with a cooperating cross section of the thermostat mounting blades 72 and 74, provides similar freedom of rotational orientation for the thermostat 60.

While the present invention has been disclosed with reference to certain preferred embodiments, these should not be considered to limit the present invention. One skilled in the art will readily recognize that variations of these embodiments are possible, each falling within the scope of the invention, as set forth in the claims below.

What is claimed is:

1. A heater apparatus comprising:

a frame;

a means for supporting a conducting wire on said frame;

a conducting wire supported on said frame by said means for supporting a conducting wire, said conducting wire having a terminal end;

a first insulating guide mounted to said frame, having a front face and a back face, and a passage extending from said front face to said back face in an axial direction;

a second insulating guide mounted to said frame, having a front face and a back face, and a passage extending from said front face to said back face in said axial direction;

a first terminal connection member extending through said passage of said first insulating guide, having a first end portion protruding from said front face and a second end portion protruding from said back face, a means for connecting to said terminal end of said resistive wire located proximal to the first end, and a through hole located proximal to the second end and extending in a direction normal to said axial direction;

a second terminal connection member extending through said passage of said second insulating guide, having a first end portion protruding from said front face of said second insulating guide and a second end portion protruding from said back face of said second insulating guide, a means for connecting to a terminal end of a conductive element located proximal to said first end portion, and a through hole located proximal to said second end portion and extending in a direction normal to said axial direction;

a thermostat having a first connection terminal and a second connection terminal, said first connection terminal having a though hole aligned with and extending in the direction of the though hole in the first terminal connection member, said second connection terminal having a through hole aligned with and extending in the direction the through hole in the second terminal connection member;

a first threaded screw extending through said hole in said first connection terminal and said second end of said first terminal connection member; and a second threaded screw extending through said hole in said second connection terminal and said second end of said second terminal connection member.

2. A heater apparatus comprising:

a frame;

a means for supporting a conducting wire on said frame;

a conducting wire supported on said frame by said means for supporting a conducting wire, said conducting wire having a terminal end;

a first insulating guide mounted to said frame, having a front face and a back face, and a passage extending from said front face to said back face in an axial direction;

a second insulating guide mounted to said frame, having a front face and a back face, and a passage extending from said front face to said back face in said axial direction;

a first terminal connection member shaped and dimensioned for insertion into said passage of said first insulating guide, having a first end portion and a second end portion, a means for connecting to said terminal end of said resistive wire located proximal to the first end, a through hole located proximal to the second end and extending in a direction normal to said axial, and having means for abutting against said front face of said first insulating guide at a predetermined position of insertion, wherein said predetermined position is such that said first end portion protrudes from said front face of said first insulating guide and said second end portion protrudes from said back face of said first insulating guide;

a second terminal connection member shaped and dimensioned for insertion into said passage of said second insulating guide, having a first end portion and a second end portion, a means for connecting to a terminal end of a conducting element located proximal to the first end, a through hole located proximal to the second end and extending in a direction normal to said axial, and having means for abutting against said front face of said second insulating guide at a predetermined position of insertion, wherein said predetermined position is such that said first end portion protrudes from said front face of said second insulating guide and said second end portion protrudes from said back face of said second insulating guide;

a thermostat having a first connection terminal and a second connection terminal, said first connection terminal contacting the second end of said first terminal connection member and having a though hole aligned with and extending in the direction of the though hole in the first terminal connection member, said second connection terminal contacting the second end of said second terminal connection member and having a through hole aligned with and extending in the direction the through hole in the second terminal connection member;

a first threaded screw extending through said hole in said first connection terminal and said second end of said first terminal connection member; and a second threaded screw extending through said hole in said second connection terminal and said second end of said second terminal connection member.

3. A heater apparatus comprising:

a frame having means for supporting a resistive heating wire;

an insulating means secured to said frame, said insulating means having a first support and a second support;

a first connection member secured to the first support of the insulating means and aligned on an axis, the first connection member having a first end and a second end displaced from one another on said axis, and having a first through hole proximal to said first end extending in a first direction normal to said axis, and having a means for connecting to a wire end located at its second end;

a second connection member secured to the second support of the insulating means and aligned on said axis, the second connection member having a first end and a second end displaced from one another on said axis, and having a second through hole proximal to said first end extending in said first direction, and having a means for connecting to a wire end located at its second end; and a thermostat having a first connection terminal and a second connection terminal, said first connection terminal having a third through hole and said second connection terminal having a fourth through hole, wherein said first connection terminal is secured to said first connection member such that said third through hole is aligned with and extends parallel to said first through hole, and said second connection terminal is secured to said second connection member such that said fourth through hole is aligned with and extends parallel to said second through hole.

4. A heater apparatus according to claim 3 wherein said first connection terminal is secured to said first connection member by a first threaded screw extending through and in a threaded engagement with at least one of said first connection terminal and said first connection member, and said second connection terminal is secured to said second connection member by a second threaded screw extending through and in a threaded engagement with at least of one of said second connection terminal and said second connection member.

5. A heater apparatus according to claim 3 wherein said first support includes a front face and a back face, spaced apart from another by a distance, and a support hole extending along said axis from said front face to said back face, and said first connection member comprises an elongated plate having a center section, said center section extending through said support hole, and having a back abutment projecting from said second end and abutting against said back face, and having a front abutment projecting from said first end and abutting against said front face, whereby said first connection member is secured from movement in the direction of said axis by said front and back abutments contacting said front and back face.

6. A heater apparatus according to claim 1 further comprising:

a third insulating guide, structurally identical to at least one of said first insulating guide and said second insulating guide, forming a third passage; and a third connection member, extending through said third passage, having a first end and a second end opposite from said first end, said first end forming an external connection member and said second end having means for connecting to a conducting member.

7. A heater apparatus according to claim 2 further comprising:

a second insulating means secured to said frame, said insulating means having a third support structurally identical to at least one of said first and second supports; and an external connection member secured to the third support.

* * * * *

UNITED STATES PATENT AND TRADEMARK OFFICE

CERTIFICATE OF CORRECTION

PATENT NO. : 6,433,318 B2
DATED : August 13, 2002
INVENTOR(S) : Danko

It is certified that error appears in the above-identified patent and that said Letters Patent is hereby corrected as shown below:

Title page,
Item [60], should read:

-- Related U.S. Application Data
[60] Provisional application No. 60/255,042 filed on Aug. 11, 2000. --

Signed and Sealed this

Eighteenth Day of March, 2003

JAMES E. ROGAN
*Director of the United States Patent and Trademark Office*